United States Patent [19]

Karpf

[11] 3,966,118

[45] June 29, 1976

[54] AUTOMATIC REGULATING EQUIPMENT FOR A HEATING DEVICE HAVING A VAPORIZING BURNER

[76] Inventor: Ferdinand Karpf, 7, Josef Brennerstrasse, A-3400 Klosterneuburg, Austria

[22] Filed: June 18, 1975

[21] Appl. No.: 588,041

[30] Foreign Application Priority Data

June 19, 1974 Austria ..... 5074/74

[52] U.S. Cl. ..... 237/2 A; 431/78

[51] Int. Cl.[2] ..... G05D 23/00

[58] Field of Search ..... 431/28, 78, 82, 26; 236/15; 237/2 R, 2 A

[56] References Cited

UNITED STATES PATENTS

| | | | |
|---|---|---|---|
| 3,352,490 | 11/1967 | Dalzell et al. | 236/15 B |
| 3,644,074 | 2/1972 | Cade | 431/26 |
| 3,816,053 | 6/1974 | Cade | 431/78 |

*Primary Examiner*—Edward G. Favors

*Attorney, Agent, or Firm*—Salter & Michaelson

[57] ABSTRACT

A fully automatic regulating equipment for a heating device having an oil vaporizing burner, for instance for a central heating furnace, comprises a thermostat responsive to the output hot water temperature or to the room temperature and having a contact which is arranged in series with an electronic time delay relay by which an ignition member activated by a surface thermostat, the bi-metallic heating winding of an oil control regulator and the excitation winding of a solenoid operated valve arranged in the pipeline leading to the burner can be switched to the main voltage. The equipment further comprises a thermo-relay arranged in series with the contact of the time delay relay and parallel to the excitation winding of the ignition member. The thermo relay is operated to switch the bi-metallic heating winding of the oil control regulator and the excitation winding of the solenoid operated valve with time delay with respect to the winding of the ignition member, to the main voltage.

12 Claims, 3 Drawing Figures

AUTOMATIC REGULATING EQUIPMENT FOR A HEATING DEVICE HAVING A VAPORIZING BURNER

Figure 1:
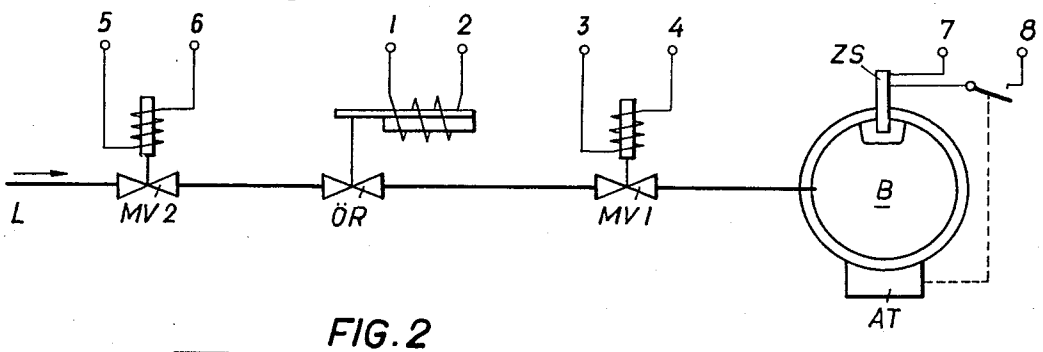

The present invention refers to a fully automatic regulating equipment for a heating device having a vaporizing burner. Such heating devices are for instance central heating furnaces or oil stoves. It has already been proposed to provide such an equipment with a thermostat responsive to the output water temperature or to the room temperature and controlling a time delay relay arranged in series with the contact of the thermostat. The time delay relay is operative to connect an ignition member, the bi-metallic heating winding of an oil control regulator and the excitation winding of a solenoid operated valve arranged in the oil pipeline leading to the burner to the main voltage. The ignition member is controlled by a surface thermostat.

Such a regulating equipment has been become known from the German published specification No. 2.320.892 and has the advantage in comparison with former regulating equipments for heating devices having an oil vaporizing burner, of a genuine on-off-control, whereas the mentioned known devices have only maximum-minimum control. The time delay relay is to avoid a re-ignition of a vaporizing burner still warm from previous operation, which could result in an unwanted combustion of the vaporized oil.

The disadvantage of an equipment mentioned, is, however, that the mechanically operated time delay relays used up to now are relatively space-consuming so that it was not possible to combine the members of the electric regulating equipment in a very space-saving manner because space-saving electronic time-delay relays could not be used heretofore because of their sensitivity to external and/or internal undesired influences, mainly disturbing voltages in use of the power main net. These disturbing influences may lead to a premature switching on of the relay (i.e. before the switch-set time is completed), so that a dangerous explosion-like combustion of the heating oil flowing into the burner may yet occur while the vaporizing burner is still hot from previous operation and the ignition system is not yet operative.

It is an object of the present invention to improve a fully automatic regulating equipment of the kind indicated above so that it is less space-consuming.

It is a further object of the invention to improve the known fully automatic regulating equipment so that it has an improved safety of operation.

It is a further object of the invention to provide for a regulating equipment with less effort.

The invention consists in that a thermo-relay is arranged in series with the contact of the electronic time delay relay and in parallel with the input of the ignition member and that this thermo-relay is operative to contact the bi-metallic heating winding of the oil control regulator and the excitation winding of the solenoid actuated valve to the main voltage with a time delay with respect to the moment at which the ignition member is switched to the mains voltage.

The invention enables that, when the bi-metallic heating winding of the oil control regulator and the excitation winding of the solenoid operated valve are switched on, the ignition point or other ignition member has already reached its temperature necessary for ignition of the fuel oil streaming into the burner, so that for the possibility of an unforeseen exceptional case of a premature switching on of the electronic time delay relay, when the vaporizing burner is still hot from previous operation, an explosive-like ignition of the fuel oil is reduced in effect to a minimum.

According to a preferred embodiment of the invention the critical heat point of the thermo-relay system is about 60 to 90 seconds, which corresponds approximately to the starting time of conventional ignition systems.

Figure 2:
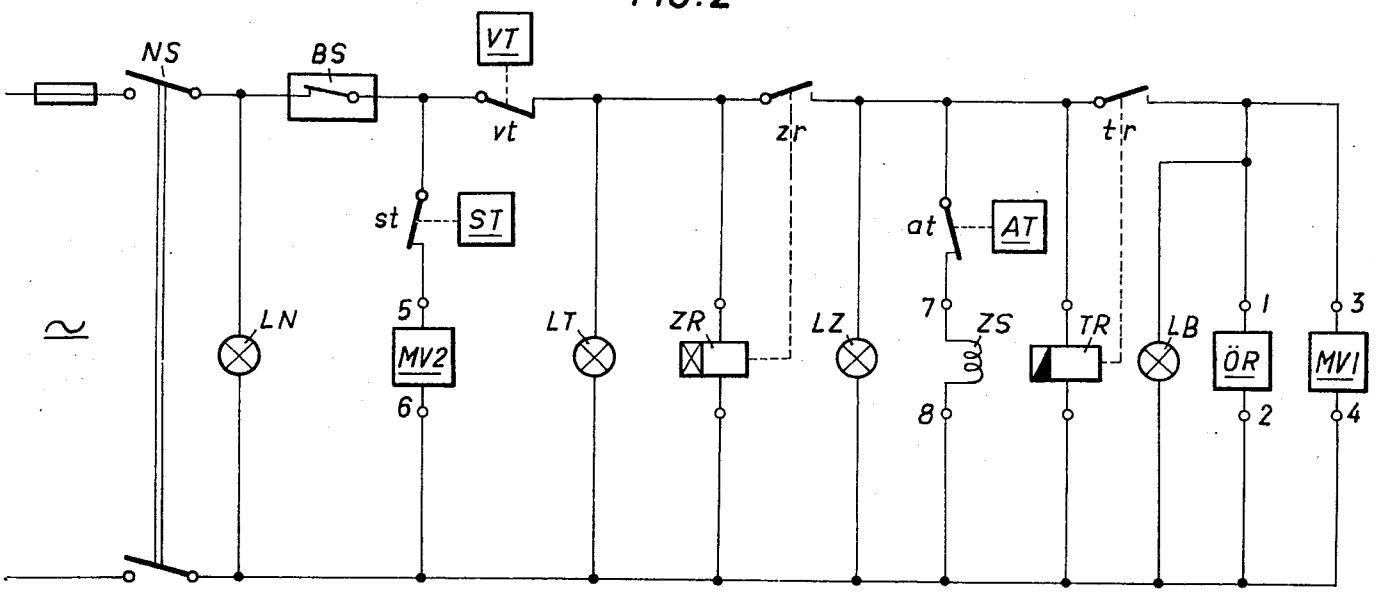
Figure 3:
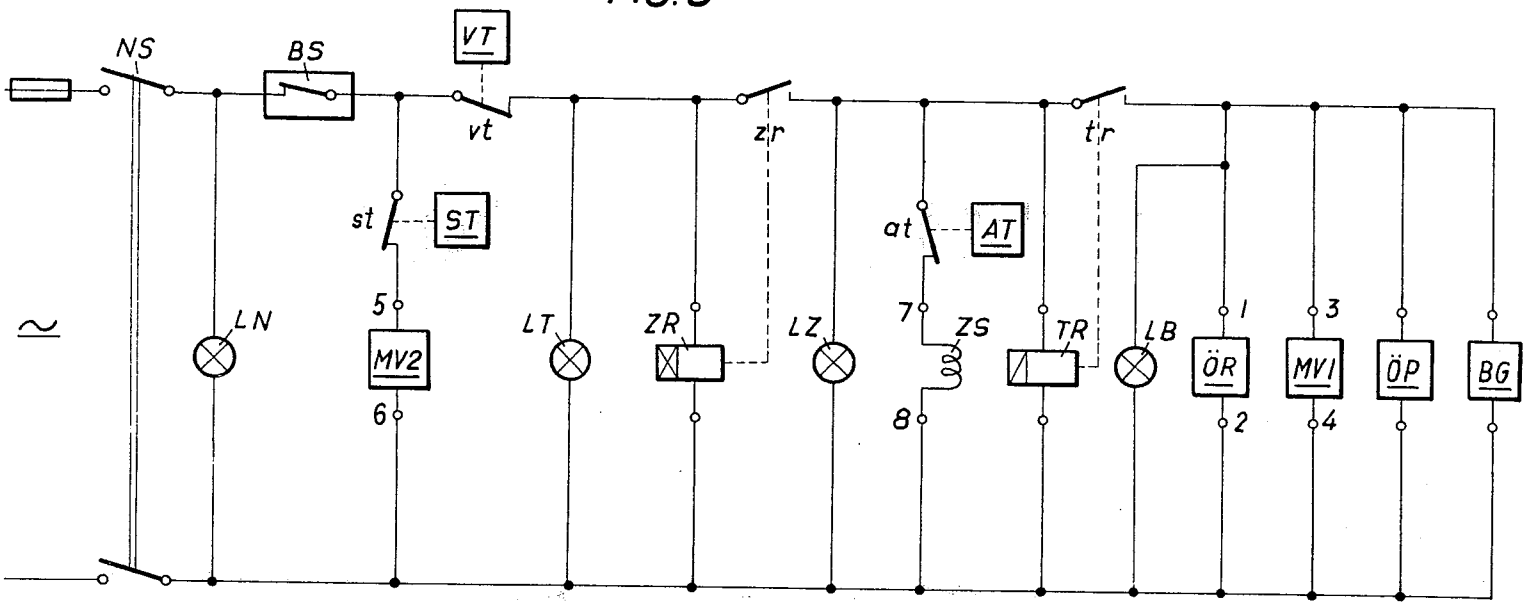

In the accompanying drawing the invention is shown by way of example. FIG. 1 shows a schematical representation of the oil supply line and of the burner whereby the individual arrangement of the elements is demonstrated. FIG. 2 shows the electrical circuit diagram of the inventive regulating equipment. FIG. 3 shows a variant of the circuit diagram of FIG. 2.

In FIGS. 2 and 3 all contacts are shown at rest, i.e. when the circuit diagram is switched off from the mains voltage.

In the fuel feed line L running from the tank (not shown) in direction to the vaporizing burner B (FIG. 1), the fuel flow is in direction of the arrow indicated. In the fuel line L there is mounted an oil control regulator ÖR, comprising a control valve which is operated by means of a bi-metal in a manner well known for one skilled in the art. The bi-metal which may be a strip or of other configuration, is heated by a heating winding of the control section mounted on top of the oil control regulator, the terminals of the heating winding being marked with 1 and 2.

Situated between the oil control regulator ÖR and the vaporizing burner B, a first solenoid-operated valve MV1 is mounted, which turns on or off the fuel flow to the vaporizing burner, in course of the on-off regulation. The terminals of the solenoid induction winding of the solenoid operated valve MV1 are indicated by 3 and 4. Between the tank and the oil control regulator ÖR is further provided a second solenoid operated valve MV2, which is part of a special safety circuit. The terminals of the solenoid induction winding or of this latter solenoid operated valve are indicated by 5 and 6.

The ignition member or point ZS, the potential glowing spiral of which, with the terminals of the electrical feed-in as marked by 7 and 8, extends into the vaporizing burner B, whereby on the bottom of the vaporizing burner, around the ignition point, a recess is provided which is such to enable the required amount of fuel oil for ignition purposes to be present.

To the external casing of the vaporizing burner there is fixed a surface thermostat AT, which is so pre-set to cut off the ignition circuit, when the temperature of the vaporizing burner reaches its operation value.

A supply voltage of direct or alternating current is supplied to the regulating device by means of a net control switch NS (FIG. 2). The operating condition of the regulating equipment or device is indicated by a red net control lamp LN. Connected in series to this lamp LN there is arranged a series connection comprising a suitable fire protection switch member BS, the contacts *st* of a security thermostat ST and the excitation winding of the second solenoid operated valve MV2 of the security network. Connected in series to the fire protection switch BS there is arranged the contact *vt* of a thermostat VT responding to the room temperature or to the temperature of the hot water in the pipeline leading to the radiators of the central heating equipment, and further a yellow control lamp LT. Connected in series to the contact *vt* there is arranged an electronical time delay relay ZR which has an adjustable delay of coming into action of about 5 to 20 minutes, whereby an adjustment to all cases coming into consideration is possible.

The time delay relay with its contact *zr* switches a series connection to the mains voltage which consists of the contact *at* of the surface thermostat AT and of the ignition point input 7,8. Further the contact *zr* switches to the mains voltage a thermo-relay TR connected in parallel to this series connection. The thermo-relay TR has a contact *tr* which switches the bi-metallic heating winding of the oil control regulator ÖR and the excitation winding of the solenoid actuated valve MV1 to the mains voltage with time delay with respect to the time at which the terminals 7,8 of the heating winding of the ignition point are switched to this mains voltage. The operative position of the time delay relay ZR is visible by means of a blue control lamp LZ. The operation condition of the oil control regulator ÖR and of the solenoid operated valve MV1 can be indicated by switching on of a green burner control lamp LB connected in parallel to the input 1,2 of the oil regulator ÖR and to the input 3,4 of the valve MV1. If the equipment comprises an oil pump ÖP (FIG. 3), and/or a burner blower BG, the inputs of these members are connected in parallel to the bi-metallic heating winding of the oil control regualtor ÖR and to the excitation winding of the solenoid operated valve MV1 so that the oil pump ÖP and/or the burner blower BG are connected simultaneously with the regulator ÖR and the valve MV1 to the mains voltage.

The operation of the equipment is as follows:

After closing the mains voltage switch NS the net control lamp LN is flashed up and the equipment is ready for operation. If there is a demand for heat, for example if the temperature of the room to be heated is too low or if the temperature in the hot water supply line leading to the radiators of the central heating is too low, this is indicated by the thermostat VT which closes its contact *vt*. This is indicated by flashing up the control lamp LT which means that the electronic time delay relay ZR is switched to the supply voltage. After the pre-set time delay of the time delay relay ZR this relay closes its contact *zr* so that the control lamp LZ is flashed up and the ignition member ZS is switched to the supply voltage via the closed rest contact *at* of the surface thermostat AT. Simultaneously the supply voltage is switched to the thermo relay TR lying parallel to the input of the ignition member ZS. The thermo relay TR has also a certain time delay for closing its contact *tr*, so that at the moment in which the contact *tr* is closed and the heating winding or the bi-metallic member of the oil control regulator ÖR and the excitation winding of the solenoid operated valve MV1 and, if desired, the oil pump ÖP and/or the burner blower BR are switched to the supply voltage, the ignition is completely ready for operation so that the oil entering the burner B can be immediately ignitioned.

The oil control regulator ÖR controls the oil supply in the burning phase of the burner B with its bi-metallic element heated up by the heating winding, the input 1,2 of which is switched to the supply voltage in the manner indicated above. When the desired temperature of the room to be heated or the hot water in the pipe line leading to the radiators (not shown) is reached, the contact *vt* opens, so that the valve MV1 is switched off from the supply voltage and interrupts the stream of oil in the pipe line L to the burner B so that burning of oil is stopped. If the temperature to be watched by the thermostat VT drops so that the contact *vt* of the thermostat VT closes anew, a new cycle of operation of the device starts.

The security circuit comprising the security thermostat ST and the second solenoid operated valve MV2 is provided as a security means for the unintended event that the thermostat VT does not open its contact *vp* due to a defect. If, for example, the first solenoid operated valve MV1 does not close tightly so that oil is supplied continously to the burner B, the temperature in same would be too high and this increase of temperature would not observed by the thermostat VT due to its defect. Also, the solenoid operated valve MV1 might not close due to another reason. Under these circumstances the equipment with its burner B would heat beyond the preset temperature value which should be controlled by means of the thermostat VT. In this event, however, the security thermostat ST will become operative when a preset temperature is reached and will open its rest contact *st*, so that the second solenoid operated valve MV2 is shut off from the voltage supply. The valve MV2 closes then and interrupts the oil supply to the burner B. Generally, the second solenoid operated valve MV2 is positioned in the oil supply line L (FIG. 1) in front of the oil control regulator ÖR seen in direction of the flow of the oil. This second valve MV2 constitutes an additional security means which is of advantage in the event that the first solenoid operated valve MV1 does not reliably close due to a mechanical defect or due to soiling or due to an electrical defect. Thereby it is avoided that the equipment heats to undesired temperature values, or that the water in the central heating system becomes overheated or boiling, respectively.

Preferably, the security thermostat ST is a self-locking thermostat which prevents a re-switching in of the equipment before the defect has been removed.

A further advantage of the security circuit mentioned above is that, if the thermostat VT and/or the time delay relay ZR and/or the thermo relay TR and/or other elements become defective, an emergency operation of the heating equipment can be maintained by hand. Further, an operation for testing and/or service purposes is possible. This can be done by adjusting the first solenoid operated valve MV1 to a free passage of the oil by hand, which e.g. can be done by decoupling of the closure member of the valve. Further, the control section provided on the oil control regulator ÖR in a well known manner and having a heated bi-metal-element, also is set to operation by hand, so that the oil control regulator can be actuated by hand like within an usual oil stove. The ignition of the oil can be done by hand too. Under these circumstances the temperature control can be coarsely done by positioning the oil control regulator ÖR to the desired position by hand. In this case the temperature is controlled by the security thermostat ST together with the second solenoid operated valve MV2 in the manner that if the temperature to be controlled exceeds the preset maximum temperature of the security thermostat ST, this thermostat switches off the excitation winding of the solenoid operated valve MV2 whereby this valve shuts off the oil supply to the burner B. The equipment can only reswitched in by hand. Thus it is possible to maintain the equipment in emergency operation until the defect has been removed, which is of great advantage for rooms in which a break down of the heating can have grave consequences.

Preferably the thermo-relay TR is positioned in a separate casing spaced apart from the electronic time-delay-relay ZR in Order to avoid that the time-delay-relay is subjected to the heat radiation of the thermo-relay which should lead to an unexactness in operation of the time-delay-relay or to a defect of one of its elements.

Further, it is of advantage to combine the electrical control elements of the equipment to a single unit and to position this unit shielded from direct heat radiation of the heat element, if desired in another room.

The single electrical or electronical elements of the control equipment as it is shown in the drawings are well known for one skilled in the art so that these elements need not to be described in detail. As it is well known, a thermo-relay comprises a bi-metal strip forming part of the contacts of the relay, which bi-metal strip is moved by energising or de-energising of a heating winding.

Electronic time-delay-relays are also well known. The time-delay can easily be achieved by e.g. loading a condensor.

As it can be seen from FIGS. 2 and 3, the contact *st* of the security thermostat or safety thermostat ST is connected in series to the excitation-winding 5,6 of the second solenoid operated valve MV2. This series connection is connected in parallel to the input terminals of the time-delay-relay ZR, whereby a simple circuit diagram is achieved which can be easily overlooked when manufacturing or servicing it.

As it has been already mentioned, the thermostat VT watches the temperature of a medium to be controlled. This temperature can be the temperature of a room to be heated or the temperature of the hot water in the pipe lines of a central heating system.

What I claim is:

1. A full automatic regulating equipment for a heating device having an oil burner adapted to vaporise and burn fuel oil, an oil supply line leading to said burner, and an electrically heated ignition member for ignitioning the oil within said burner, input terminals for said ignition member, the equipment comprising a first thermostat responsive to the temperature of the burner, a contact of said first thermostat being adapted to control the delivery of electrical energy to said input terminals of said ignition member, an oil control regulator having a bi-metal element and a heating winding adapted to heat the bi-metal element, a first solenoid-operated valve having an excitation winding, said oil control regulator and said first solenoid-operated valve being inserted in the oil supply line and adapted to control the stream of oil flowing through this line, a second thermostat responsive to the temperature of a medium to be heated by the burner and having a contact, an electronic time-delay-relay having input terminals and a contact, said input terminals of the time-delay-relay being connected in series to the contact of said second thermostat, a thermo-relay having input terminals and a contact, said imput terminals of said thermo-relay being connected in series with the contact of said time-delay-relay and in parallel with said input of said ignition member, so that said time-delay-relay with its contact switches the input terminals of said ignition member, the heating winding for said bi-metal element of said oil control regulator and the excitation winding of said first solenoid-operated valve to the supply voltage, whereas the thermo-relay with its contact switches the heating winding of the bi-metal element of said oil control regulator and the excitation winding of said first solenoid-operated valve with time delay to the supply voltage with respect to the input terminals of said ignition member.

2. An equipment as claimed in claim 1, wherein the time of said thermo-relay for coming into action amounts to about 60 to 90 seconds.

3. An equipment as claimed in claim 1, wherein said thermo-relay is separated from said electronic time-delay-relay and positioned in an own casing.

4. An equipment as claimed in claim 1, wherein at least said thermo-relay and said time-delay-relay are positioned spaced apart from said burner.

5. An equipment as claimed in claim 4, wherein at least said thermo-relay and said time-delay-relay are positioned in another room then the burner.

6. An equipment as claimed in claim 1, further comprising a safety circuit having a safety thermostat and a second solenoid-operated valve inserted in said oil supply line and having an excitation winding connected in parallel to said heating winding of said bi-metal element of said oil control regulator and to the excitation winding of said first solenoid-operated valve, said safety thermostat having a contact which switches said excitation winding of the second solenoid-operated valve to the supply voltage.

7. An equipment as claimed in claim 6, wherein said contact of said safety thermostat and said excitation winding of said second solenoid-operated valve are connected in series to each other to form a series connection, said series connection being connected in parallel to the input terminals of said time-delay-relay.

8. An equipment as claimed in claim 6, wherein said safety thermostat is a self-locking thermostat.

9. An equipment as claimed in claim 1, further comprising an oil pump having input terminals, said input terminals being connected in parallel to said excitation winding of said first solenoid-operated valve.

10. An equipment as claimed in claim 6, further comprising an oil pump having input terminals, said input terminals being connected in parallel to said excitation winding of said first solenoid-operated valve.

11. An equipment as claimed in claim 1, further comprising a burner blower having input terminals, said input terminals being connected in parallel to said excitation winding of said first solenoid-operated valve.

12. An equipment as claimed in claim 6, further comprising a burner blower, having input terminals, said imput terminals being connected in parallel to said excitation winding of said first solenoid-operated valve.

* * * * *